US009795207B2

(12) United States Patent
Denece et al.

(10) Patent No.: US 9,795,207 B2
(45) Date of Patent: Oct. 24, 2017

(54) CASE, SPECIFICALLY FOR CONTAINING A STICK SUCH AS A LIPSTICK, AND PRODUCT INCLUDING A STICK PACKAGED IN SUCH A CASE

(71) Applicant: AXILONE PLASTIQUE, Auray (FR)

(72) Inventors: Jean-Paul Denece, Baden (FR); Hubert Allain, Long Island City, NY (US)

(73) Assignee: AXILONE PLASTIQUE, Auray (FR)

( * ) Notice: Subject to any disclaimer, the term of this patent is extended or adjusted under 35 U.S.C. 154(b) by 0 days.

(21) Appl. No.: 15/125,512

(22) PCT Filed: Mar. 9, 2015

(86) PCT No.: PCT/FR2015/050575
§ 371 (c)(1),
(2) Date: Sep. 12, 2016

(87) PCT Pub. No.: WO2015/136202
PCT Pub. Date: Sep. 17, 2015

(65) Prior Publication Data

US 2017/0086562 A1 Mar. 30, 2017

(30) Foreign Application Priority Data

Mar. 11, 2014 (FR) ..... 14 52020

(51) Int. Cl.
*A45D 40/20* (2006.01)

(52) U.S. Cl.
CPC ..... *A45D 40/205* (2013.01); *A45D 2040/207* (2013.01)

(58) Field of Classification Search
CPC ..... A45D 40/02; A45D 40/06; A45D 40/205; A45D 40/12; A45D 2040/207; A45D 2040/208
See application file for complete search history.

(56) References Cited

U.S. PATENT DOCUMENTS 3,036,702 A * 5/1962 Davis ..... A45D 40/06 401/62
3,197,024 A 7/1965 Bau
(Continued)

FOREIGN PATENT DOCUMENTS

FR 2 229 364 A1 12/1974

OTHER PUBLICATIONS

International Search Report, dated Apr. 28, 2015, from corresponding PCT application.

*Primary Examiner* — Jennifer C Chiang
*Assistant Examiner* — Bradley Oliver
(74) *Attorney, Agent, or Firm* — Young & Thompson

(57) ABSTRACT

A case for containing a stick such as a lipstick includes: a cup forming a cavity for the stick; a tubular sheath, extending along the longitudinal axis, in which the cup is held, the sheath including a transverse bottom and an upper transverse opening oriented in a so-called "front" direction, the sheath including an element, for translatably guiding the sheath along the longitudinal axis of the cup, and a mechanism for actuating the translation of the cup along the longitudinal axis within the sheath; and a push member translatably mounted along the longitudinal axis relative to the cup and including a head, capable of being placed in the cavity of the cup, and at least one arm, extending along the longitudinal axis. The arm has at least one transverse catch.

12 Claims, 4 Drawing Sheets

(56) References Cited

U.S. PATENT DOCUMENTS

| | | | | |
|---|---|---|---|---|
| 3,913,595 | A | 10/1975 | Grisel | |
| 6,022,160 | A * | 2/2000 | Sakurai | A45D 40/02<br>401/49 |
| 6,343,886 | B2 | 2/2002 | Shochat | |
| 2001/0014247 | A1 * | 8/2001 | Shochat | A45D 40/06<br>401/87 |

* cited by examiner

CASE, SPECIFICALLY FOR CONTAINING A STICK SUCH AS A LIPSTICK, AND PRODUCT INCLUDING A STICK PACKAGED IN SUCH A CASE

The invention relates to the field of packaging for sticks of material to be applied by friction, especially a stick of lipstick or the like. More particularly, it relates to sticks of material that are solid or semi-solid, in other words which retain their general stick-like shape and their volume under normal conditions of use. It relates in particular to a case for such a stick of material to be applied, and to a product comprising a stick of material contained in such a case.

BACKGROUND OF THE INVENTION

In general, a lipstick case comprises a cup housed in a sheath. The cup is guided in translational movement within the sheath. Actuating elements are accessible on the outside of the sheath to cause translational movement of the cup. In a known manner, the actuating elements comprise a part that rotates on the sheath, manipulatable by a user and imparting translational movement to the cup via a helical type of connection.

The cup is in the form of a bowl forming a housing for the stick. The stick is intended to be introduced into the housing of the cup, to remain there for the duration of the case's service life. The stick can therefore be forced into the cup, where friction between the stick and the cup prevents the stick from leaving the housing. The cup may also include specific elements such as grooves to retain the stick in the cup. A portion of the stick is thus lodged in the cup, where it remains inaccessible to the user. The larger this lodged portion, the better the retention of the stick in the cup but the larger the inaccessible portion in the cup will be. This results in waste, perceptible to the user.

Document U.S. Pat. No. 6,343,886 proposes a lipstick case comprising elements for recovering a portion of the product lodged in the cup. For this purpose, a push member that is movable relative to the cup is provided, which allows pushing the stick out of the cup. More specifically, translational movement of the cup in a first direction is actuated in the manner described above, by means of a helical connection, to expose the stick from the sheath. When the accessible portion of the stick exposed outside the sheath has been used up, translational movement of the cup is actuated in the other direction, returning it into the sheath. The push member comprises two arms projecting out of the cup, which are supported on the bottom of the sheath. The force of the push member pushing against the bottom moves the push member relative to the cup. The previously inaccessible portion of the stick is thus partially pushed out of the cup by the push member. Catches on the push member arms prevent the push member from returning to its initial position. The cup can then be reactuated in the first direction, so that the rest of the stick is now accessible to the user.

Although this system allows recovering some of the previously inaccessible portion of the stick, it requires returning the cup and the push member to the bottom of the sheath in order to push the arms against the bottom. This can be a chore for the user, who will not necessarily have the reflex to return the cup all the way into the sheath; this is even more true when the sheath is long.

Document U.S. Pat. No. 6,343,886 also proposes setting up a breakable bridge on the path of the cup, which prevents contact between the arms of the push member and the sheath bottom and which must be broken to place the push member arms in contact with the bottom of the sheath. Here again, the user does not necessarily have the reflex to force the movement of the cup once it has been fully returned into the sheath, and displacement of the push member within the cup is not obtained.

There is therefore a need for a novel case for a stick of solid or semi-solid material that limits waste while providing a solution to the above disadvantages.

SUMMARY OF THE INVENTION

According to a first aspect, the invention relates to a case specifically designed to contain a stick of solid or semi-solid product of material to be applied by friction, in particular a stick of lipstick, the case comprising:

- a cup, forming a housing for the stick,
- a tubular sheath extending along the longitudinal axis, in which the cup is housed, and comprising at a distal end a transverse bottom and at a proximal end a transverse opening, the sheath comprising elements for guiding the cup, in translational movement within the sheath along the longitudinal axis, in a so-called "forward" direction along the longitudinal axis from the distal end toward the proximal end of the sheath and in a so-called "rearward" direction along the longitudinal axis from the proximal end toward the distal end of the sheath,
- a push member mounted to enable translational movement along the longitudinal axis relative to the cup, and comprising a head adapted to be placed in the housing of the cup and at least one arm extending along the longitudinal axis, the arm bearing at least one sheath-arresting catch,
- elements for actuating the translational movement of the cup along the longitudinal axis relative to the sheath, alternately in the forward direction and in the rearward direction.

The sheath further comprises stop elements for engaging with the at least one sheath-arresting catch, the sheath-arresting catches extending transversely so as to engage with the stop elements, allowing forward translational movement of the push member relative to the sheath along the longitudinal axis and serving to block rearward translational movement of the push member relative to the sheath along the longitudinal axis.

Rearward translational movement of the cup along the longitudinal axis when the push member is in abutment against the stop elements then causes forward translational movement of the push member relative to the cup along the longitudinal axis.

Thus, as it imparts a rearward movement to the cup, the push member abuts against the stop elements by means of its sheath-arresting catch, at a distance from the bottom, pushing on the stick and causing it to leave the cup without needing to return the cup to an initial position at the bottom of the sheath.

According to one embodiment, the push member comprises a plurality of sheath-arresting catches distributed along the longitudinal axis which allow forward translational movement of the push member relative to the sheath along the longitudinal axis and which successively engage with the hooking elements by forward translational movement of the cup relative to the sheath along the longitudinal axis to block rearward translational movement of the push member relative to the sheath along the longitudinal axis.

The stick can then be gradually expelled from the cup as it is used up, by successive use of the sheath-arresting catches.

According to one embodiment, the cup comprises a transverse base in which an opening is provided. The head of the push member extends forward from the base of the cup and the arm traversing the opening in the cup. The arm further comprises a cup-arresting catch, extending transversely and engaging with the edge of the hole of the cup to permit forward translational movement of the push member relative to the cup along the longitudinal axis and to block rearward translational movement of the push member relative to the cup along the longitudinal axis.

For example, the arm comprises, starting from the head of the push member, a first catch serving as a cup-arresting catch and a last catch serving as a sheath-arresting catch. The arm further comprises at least one second catch arranged on the arm between the first catch and the last catch, the second catch being dimensioned to serve as a sheath-arresting catch and as a cup-arresting catch.

The catch or catches may be elastically deformable.

According to one embodiment, the stop elements comprise at least one arresting finger projecting from the sheath bottom and extended by a hook intended to engage with the at least one sheath-arresting catch.

For example, the push member comprises two arms extending along the longitudinal axis, each catch of one arm being transversely aligned with a catch of the other arm. The sheath then comprises two arresting fingers, each arresting finger being adapted to engage with the catch or catches of a corresponding arm.

According to one embodiment, the sheath comprises a tubular outer shell and a tubular inner shell that is mounted so as to rotate about the longitudinal axis within the outer shell and is blocked from translational movement within the outer shell along the longitudinal axis. The elements for actuating translational movement of the cup within the sheath along the longitudinal axis then comprise elements for actuating rotation of the inner shell relative to the outer shell, for example in the form of a sleeve assembled so as to rotate on the outer shell and rigidly fixed on the inner shell.

For example, the inner shell is in a helical connection with the cup and the outer shell is in a sliding connection with the cup. Alternatively, it is the outer shell which is in a helical connection with the cup and it is the inner shell which is in a sliding connection with the cup.

According to one embodiment, the case further comprises a removable cap for sealing the opening of the sheath.

According to a first aspect, the invention relates to a packaged product, particularly a cosmetic product, comprising a stick of material to be applied by friction, the stick being contained in a case as presented above.

BRIEF DESCRIPTION OF THE DRAWINGS

The figures in the drawings will now be briefly described.

DETAILED DESCRIPTION

Figure 1:
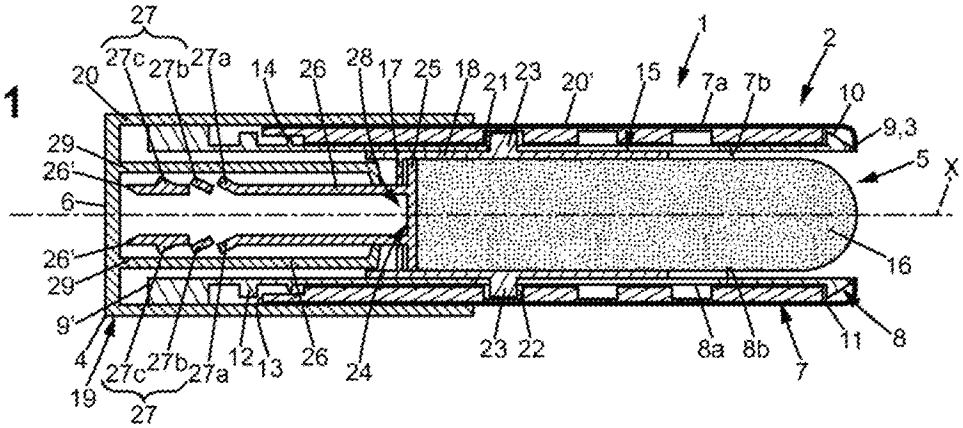
FIG. 1 is a diagram corresponding to a cross-section of a case for a stick, such as a case for lipstick, comprising a cup and a push member in a first position corresponding to the initial position.
Figure 2:
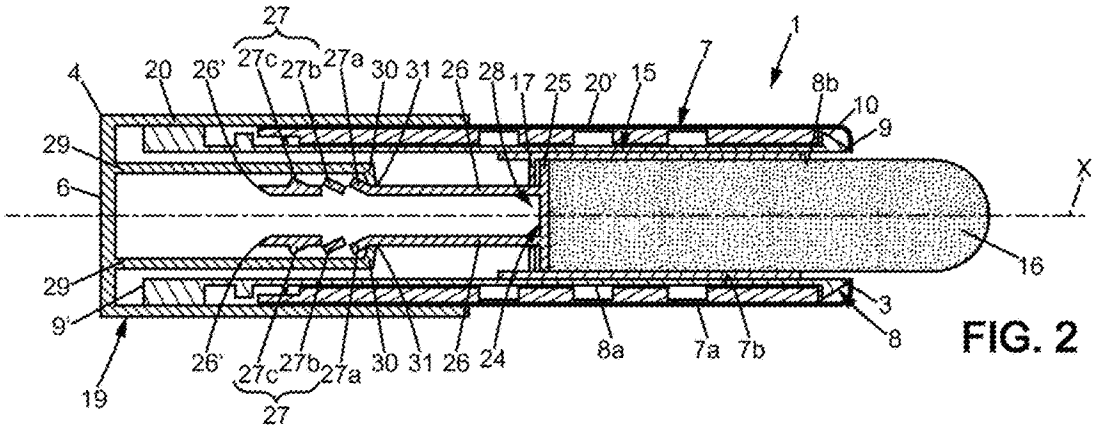
FIG. 2 represents the case of FIG. 1 in a second position where the cup supporting a stick of lipstick has been moved in a first direction relative to FIG. 1, driving the push member so that the stick is exposed.

Below is a detailed description of several embodiments of the invention, with accompanying examples and with reference to the drawings.

FIGS. 1 to 8 illustrate a case 1, and more particularly a lipstick case for a solid or semi-solid stick of a product of material to be applied by friction, in particular a stick of lipstick. The case 1 comprises a tubular sheath 2 which is in the form of a substantially cylindrical hollow body extending along a longitudinal axis X.

In the following, the word "longitudinal" refers to any direction substantially parallel to the longitudinal axis X. The word "transverse" therefore refers to any direction substantially perpendicular to the longitudinal axis X.

The sheath 2 extends between a proximal end 3 and a distal end 4. The proximal end 3 of the sheath 2 has a transverse opening 5, while the distal end 4 is closed off by a transverse bottom 6.

In the following, "forward" refers to the direction along the longitudinal axis X from the distal end 4 toward the proximal end 3 of the sheath 3. "Rearward" refers to the direction opposite to the forward direction along the longitudinal axis X, in other words from the proximal end 3 toward the distal end 4.

According to one embodiment, the sheath 2 comprises an outer shell 7 and an inner shell 8 that is fitted into the outer shell 3. The two shells 7, 8 are substantially cylindrical hollow bodies, of longitudinal axis X, that are open at both ends. The outer body 7 has a side wall defined between an outer surface 7*a* and an inner surface 7*b*. Similarly, the inner shell 8 has a side wall defined between an outer surface 8*a* and an inner surface 8*b*. The outer shell 7 and inner shell 8 are dimensioned so that the inner shell 8 fits into the outer shell 7 with a minimal clearance between the outer surface 8*a* of the inner shell 8 and the inner surface 7*b* of the outer shell 7 that is just sufficient to allow the inner shell 8 to pivot within the outer shell 7 about the longitudinal axis X in a guided manner. For this purpose, the outer surface 8*a* of the inner shell 8 and the inner surface 7*b* of the outer shell 7 have a substantially circular cross-section.

Towards its proximal end 9, the inner shell 8 comprises a first transverse flange 10 around the opening 5 of the sheath 2, forming an abutment preventing longitudinal movement, which the proximal end 11 of the outer shell 7 presses against to block its forward translational movement along the longitudinal axis X. It is then understood that the proximal end 9 of the inner shell 8 is coincident with the proximal end 4 of the sheath 2. A second transverse flange 12 is also provided on the inner shell 8, at a distance from the first flange 10, towards the distal end 9' of the inner shell 8. The second flange 12 forms an abutment preventing longitudinal movement, which the distal end 13 of the outer shell 7 presses against to block its rearward translational movement along the longitudinal axis X. The outer shell 7 is then lodged between the two flanges 12, 13. The length of the inner shell 8, meaning its dimension along the longitudinal axis X, is greater than the length of the outer shell 7, such that the distal end 9' of the inner shell 8 lies beyond the distal end 13 of the outer shell 7, the outer shell 8 having a distal portion protruding beyond the distal end 13 of the outer shell 7.

The inner shell 8 further comprises a lip 14 projecting transversely, pressing against the inner surface 7*b* of the outer shell 7 so as to control the torque between the outer shell 7 and the inner shell 8.

The case 1 comprises a cup 15 in the form of a bowl, forming a housing for the stick which is, for example, a stick 16 of lipstick. The cup comprises a transverse base 17, from which a side wall 18 rises. The dimensions of the cup 15, and in particular its transverse dimensions, enable it to be inserted into the sheath 2 with minimal clearance between the side wall 18 of the cup 15 and the inner surface 8*b* of the inner shell 8 that is just sufficient to allow longitudinal translational movement of the cup 15 relative to the sheath 2.

The cup 15 is mounted to allow longitudinal translational movement in the sheath 2, the sheath 2 being provided with elements for actuating translational movement along the longitudinal axis X of the cup 15. For this purpose, the sheath 2 is provided with a mechanism 19 for actuating the cup 15. For example, the actuating mechanism 19 comprises elements for actuating rotation of the inner shell 8, in the form of a sleeve 20 fitting over the outer shell 7 and inner shell 8. More specifically, the sleeve 20 is assembled so as to cover the outer surface 7*b* of the outer shell 7 for a given length from its distal end 13, with minimal play that is just sufficient to allow rotation of the sleeve 20 about the longitudinal axis X relative to the outer shell 7. The sleeve 20 is further prevented from both rotational and translational movement on the distal portion of the inner shell 8. For example, the sleeve 20 may be glued or snap-fitted onto the inner shell 8.

The sleeve 20 therefore leaves a portion of the outer shell 7 uncovered, at its proximal end 11. The proximal end 9 and the first flange 10 of the inner shell 8 are also uncovered. As a result, according to one embodiment, a cover shell 20' may cover the assembly formed by the outer shell 7 and the inner shell 8, from the proximal end 9 of the outer shell 8 and extending at least to the sleeve 20. For example, the cover shell 20' may be glued to the outer surface 7*a* of the outer shell 7. The cover shell 20' may also have a longitudinal dimension such that it is interposed between the sleeve 20 and the outer shell 7. In this case, the sleeve 20 is guided in rotation on the cover sheath 20' about the longitudinal axis X. The proximal end of the cover shell 20' may be folded over the proximal end 9 of the inner shell 8, so that the assembly formed by the outer shell 7 and the inner shell 8, covered by the sleeve 20 and the cover shell 20', is not visible from the outside of the case 1.

A removable cap, not shown in the figures, may be provided to fit over the sheath 2 and close the opening 5. The removable cap fits for example over the cover shell 20'.

The sleeve 20 closes off the sheath 2 at its distal end, and thereby forms the transverse bottom 6 of the sheath 2. The sleeve 20 is thus accessible to a user on the outside of the case 1. The case 1 further comprises elements for guiding the cup 15, which comprise for example a longitudinal piercing groove 21 formed on the side wall of the inner shell 8, and a helical groove 22 formed on the side wall of the outer shell 7. The cup 15 then comprises a transversely projecting pin 23, dimensioned so as to extend into the longitudinal groove 21 and beyond it into the helical groove 22. In practice, the cup 15 comprises two diametrically opposite pins 23, each engaging with both a longitudinal groove 21 of the inner shell 8 and a helical groove 22 of the outer shell 7. Alternatively, the longitudinal groove or grooves 21 may be provided in the outer shell 7, and the helical groove or grooves 22 may be provided in the inner shell 8.

Thus, rotation of the sleeve 20 in a first direction causes rotation of the inner shell 8 relative to the outer shell 7, about the longitudinal axis X. The helical grooves 21 force the pins of the cup 15 to slide in the longitudinal grooves 22. The cup 15 is thus guided in forward longitudinal translation. The stick 16 can then exit through the opening 5 of the sheath 2 and be applied. When the sleeve 20 is rotated in the other direction, the cup 15 is guided in translation in the other direction so that the cup 15 moves rearward, causing the stick 16 to retract into the sheath 2. The cup 15 can then be moved between an initial position where its rearward travel is maximal, and a final position where its forward travel is maximal.

A push member 24 is associated with the cup 15. Specifically, the push member 24 is mounted so as to move in longitudinal translation relative to the cup 15. For this purpose, the push member 24 comprises a head 25, for example in the form of a disk, having transverse dimensions substantially corresponding to the transverse dimensions of the housing formed by the cup 15, such that the head 25 can be placed in the cup 15, while allowing longitudinal translational movement of the head 25 relative to the cup 15. The push member 24 further comprises at least one arm 26 (two arms 26 in the figures), extending longitudinally rearward from the head 25 to a free end 26'. At least one catch 27, referred to as a sheath-arresting catch 2 and extending transversely, is provided on each arm 26. Preferably, the sheath 2-arresting catches 27 of the arms 26 are transversely aligned in pairs. As will be seen below, the sheath 2-arresting catch or catches 27 may be elastically deformable. When the stick 16 is housed in the cup 15, its bottom is in contact with the head 25 of the push member 24. The sheath 2-arresting catches 27 are at a distance from the free end 26' of the arms 26.

"Elastically deformable" is understood here to mean the ability of an object to deform under a given stress and to return to its initial shape in the absence of stress.

In the following description, and for the purpose of simplification, the transverse dimensions to which reference is made and which are compared are those measured in the same longitudinal plane. Thus, a transverse dimension of one element is compared here with a transverse dimension of another element in the same longitudinal plane.

The transverse base 17 of the cup 15 comprises a hole 28 traversed by the arms 26 of the push member 24, but having smaller transverse dimensions than those of the head 25 of the push member 24. Thus, the head 25 of the push member 24 lies from one side, in this case the forward side, of the transverse base 17 of the cup 15, without being able to pass through the hole 18 to the other side, while the arms 26 can slide into the hole 28. The stick 16 is in contact with the head 25 of the push member 23.

The sheath 2 further comprises at least stop elements, intended to engage with the sheath 2-arresting catches 27. For example, the stop elements comprises an arresting finger 29, in practice two arresting fingers 29 corresponding to the number of arms 26 of the push member 24. The arresting fingers 29 project longitudinally from the transverse bottom 6 of the sheath, and are intended to engage with the sheath 2-arresting catches 27. For this purpose, the arresting fingers 29 are extended at their free end by a hook 30 at a distance from the bottom 6, to engage with the sheath 2-arresting catches 27 of the push member 24. The two hooks 30 are preferably facing one another, meaning that they are aligned along the same transverse direction, and have their ends 31 towards one another.

For example, the transverse distance between the two arresting fingers 29 is greater than the transverse distance between the two arms 26, taking into account the sheath 2-arresting catches 27 of the push member 24, while the transverse distance between the ends 31 of the hooks 30 is substantially equal to the transverse distance between the two arms 26 excluding the sheath 2-arresting catches 27 of the push member 24.

The sheath 2-arresting catches 27 are then dimensioned so that the transverse dimension measured between the end of two transversely aligned sheath 2-arresting catches 27 is greater than the transverse distance between the ends 31 of the hooks 30. In this case, the sheath 2-arresting catches 27 are formed so as to incline rearwardly from their supporting arm 26, relative to the longitudinal axis X. The sheath 2-arresting catches 27 thus form a ramp, allowing the forward longitudinal translational movement of the arms 26 relative to the arresting fingers 29, and thus the forward longitudinal translational movement of the push member 24 relative to the inner shell 8.

However, the sheath 2-arresting catches 27 form a stop for the hooks 30, blocking translational movement of the push member 24 when the push member 24 is moved longitudinally rearward relative to the sheath 2. For example, the sheath 2-arresting catches 27 deform elastically to press transversely against the arms 26 and allow forward translational movement of the push member 24. When the sheath 2-arresting catches 27 have moved longitudinally beyond the hooks 30, they resume their initial shape, forming a stop for the hooks 30 and blocking the rearward longitudinal translational movement of the arms 26 of the push member 24. Alternatively, it is the arresting fingers 29 which are elastically deformable, moving transversely apart from one another when the sheath 2-arresting catches 27 pass between the ends 31 of the hooks 30.

We will now describe the different steps during an exemplary operation of the case 1.

The case 1 is first in an initial position, where the stick 16 is completely retracted within the case 1. More specifically, in this initial position the head 25 of the push member 24 is as close as possible to, possibly in contact with, the base 17 of the cup 15. The arms 26 and the sheath 2-arresting catches 27 lie between the arresting fingers 29. The free end 26' of the arms 26 is as close as possible to, possibly in contact with, the bottom 6.

When a user wants to use the case 1, he or she grasps it by the outer shell 7 or cover shell 20', and rotates the sleeve 20 of the cup 15-actuating mechanism 19 about the longitudinal axis X, obtaining the rotation of the inner shell 8 relative to the outer shell 7 and the forward longitudinal translational movement of the cup 15 relative to the sheath 2. The push member 24 is driven by the cup 15 to move in longitudinal translation relative to the sheath 2, the transverse base 17 of the cup 15 pushing the head 25 of the push member 23 forward, which causes the stick 16 to protrude through the upper opening 5 to outside the sheath 2. The stick 16 can then be used by rubbing the portion that has protruded from the case. The forward translational movement of the cup 15 and of the push member 24 relative to the sheath 2 is not hindered by the sheath 2-arresting catches 27, which form a ramp and elastically deform to allow translational movement in that direction.

The maximum forward travel of the cup 15 within the sheath 2 is determined such that the side wall 18 of the cup 15 does not exit the sheath 2, but lies flush with the proximal end 4 of the sheath 2. When all of the accessible portion of the stick 16 protruding from the cup 15, and therefore beyond the sheath 2, has been used up, the inaccessible portion of the stick 16 remaining in the cup 15 may be significant, particularly when the longitudinal dimension of the side wall 18 of the cup 15 is large.

At this stage, the sheath 2-arresting catches 27 have moved longitudinally beyond the hooks 30, and are now forward of the hooks 30. In other words, the length of the arms 26 of the push member 24, and more precisely the longitudinal distance between the sheath 2-arresting catches 27 and the head 25 of the push member 24, is chosen so that when the cup 15 is in the initial position, the distance between the sheath 2-arresting catches 27 and the hooks 30 is greater than the total travel of the cup 15 from its initial position to its final position within the sheath 2.

In order to retrieve the rest of the stick 16 lodged in the cup 15, the user can actuate the sleeve 20 of the cup 15-actuating mechanism 19 so as to move the cup 15 longitudinally rearward relative to the sheath 2. The friction between the cup 15 and the stick 16, and between the stick 16 and the head 25 of the push member, drives the push member 24 with the cup 15 rearward relative to the sheath 2. After a predefined rearward travel of the cup 15 and push member 23 relative to the sheath 2, which is less than the total travel of the cup 15, meaning its travel between the initial position and the final position, the sheath 2-arresting catches 27 of the push member 24 abut against the hooks 30, preventing any further rearward longitudinal translational movement of the push member 24 relative to the sheath 2. The free end 26' of the arms is then at a longitudinal distance from the bottom 6 of the sheath that is greater than in the initial position. As the user continues to actuate the actuating mechanism 19, the cup 15 continues to move rearward relative to the sheath 2, so that the transverse base 17 of the cup 15 moves away from the head 25 of the push member 24. Thus, the remainder of the stick 16 which was previously lodged within the housing of the cup 15 is pushed longitudinally by the push member 24 relative to the cup 15 and protrudes longitudinally beyond the side wall 18 of the cup 15.

When the user again actuates the cup 15-actuating mechanism 19 in order to expose the stick 16, the cup 15 is moved longitudinally forward relative to the sheath 2. Here again, friction between the cup 15 and the stick 16, and between the stick 16 and the head 25 of the push member, drive the push member 24 with the cup 15 forward relative to the sheath. A portion of the stick 16 that was previously inaccessible is now accessible by the upper opening 5 of the sheath 2, and can be used.

According to one embodiment, the push member 24 further comprises at least one catch **27*a*** called a cup 15-arresting catch. The cup 15-arresting catch 27*a* is substantially similar to the sheath 2-arresting catches 27, meaning that it extends transversely from the arm 26 and inclines towards the distal end 4 of the sheath 2. In addition, similarly to the sheath 2-arresting catches 27, the cup 15-arresting catch 27*a* of one arm 26 is transversely aligned with a cup 15-arresting catch 27*a* of the other arm 26. The cup 15-arresting catches 27*a* make it possible, as will be explained below, to prevent rearward longitudinal translational movement of the push member 24 relative to the cup 15, integrally securing the cup 15 and the push member 24 in the forward longitudinal translational movement of the cup 15 relative to the sheath 2. The cup 15-arresting catches 27*a* are, for example, closer to the head 25 of the push member 24 than the sheath 2-arresting catches 27.

According to another embodiment, the push member 24 comprises combination catches 27*b* which can first serve as sheath 2-arresting catches and then as cup 15-arresting catches.

An embodiment and an operation of the case 1 will now be described in greater detail with reference to FIGS. 1 to 8, where the arms 26 each comprise three catches 27*a*, 27*b*, 27*c*, successively from the head 25 of the push member 24: a first cup 15-arresting catch 27*a*, a second combination catch 27*b*, and a last sheath 2-arresting catch 27*c*.

Each catch 27*a*, 27*b*, 27*c* of an arm 26 is transversely aligned with a catch 27*a*, 27*b*, 27*c* of the other arm 26. As a result, the ends 31 of the hooks 30 of the arresting fingers 29 are transversely aligned so as to engage with the catches as a pair. Advantageously, the cup 15-arresting catch 27*a* of each arm 26 may have a transverse dimension that is smaller than that of the other catches 27*b*, 27*c*, so that it does not interact with the hooks 30 during translational movement within the sheath 2. The transverse distance between the free ends of the cup 15-arresting catches 27*a* is therefore smaller than the transverse distance between the end 31 of the hooks 30. However, the transverse distance between the free ends of the cup 15-arresting catches 27*a* is greater here than the transverse dimension of the hole 28 of the cup 15. It may be arranged to have cup 15-arresting catches 27*a* with the same dimensional characteristics as the other catches 27*b*, 27*c*, without conflicting with the principle described here.

The initial position is illustrated in FIG. 1. The free end 26' of the arms 26 is as close as possible to the transverse bottom 6 of the sheath 2. The head 25 of the push member 23 is in contact with the transverse base 17 of the cup 15. The stick 16 is in complete contact with the head 25 of the push member, and is completely retracted inside the sheath 2. In this position, the combination catch 27*b*, further from the head 25 of the push member 24 than the first cup 15-arresting catch 27*a* of each arm 26, is at a longitudinal distance from the hooks 30 that is substantially equal or slightly greater than the total travel of the cup 15, the last catches 27*c* being even further away from the hooks 30 in this first position.

The user actuates the sleeve 20 of the cup 15-actuating mechanism 19, to move said mechanism longitudinally forward and cause a portion of the stick 16 to protrude from the sheath 2. The stick 16 can then be used. The push member 24 is driven by the cup 15 in this forward movement relative to the sheath 2. The case 1 is then in a second position, where the cup 15 is not yet the end of its travel and where none of the catches 27*a*, 27*b*, 27*c* have passed beyond the hooks 30 (FIG. 2), the catches 27*a*, 27*b*, 27*c* remaining between the arresting fingers 29.

Figure 3:
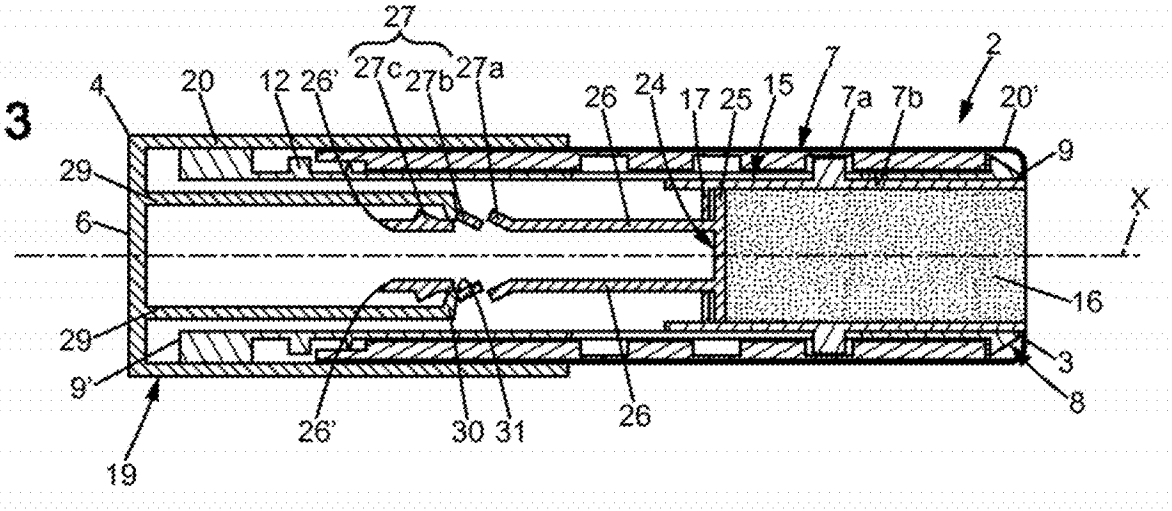
FIG. 3 represents the case of FIG. 1 in a third position where the cup has been moved further in the first direction than in FIG. 2, so that the entire accessible stick portion outside of the cup has been exposed outside the sheath, the stick portion outside of the cup having been completely used up.

When the user continues to actuate the sleeve 20 to move the cup 15 longitudinally forward relative to the sheath 2, as the stick 16 is used over time, the first catches 27*a* pass beyond the hooks 30 without producing resistance, due to their smaller transverse extension. Again, the first catches 27*a* may need to be deformed to pass beyond the hooks 30. It is advantageous, however, for the first catches 27*a* not to be deformed, so that the longitudinal translational movement of the cup 15 within the sheath 2 occurs smoothly, because the user manipulating the sleeve 20 then does not feel any variation in the force required to rotate the sleeve 20 and advance the cup 15. Then, just before the cup 15 reaches the end of its travel, the second catches 27*b* deform to pass longitudinally beyond the hooks 30. Once the second catches 27*b* have passed beyond the hooks 30, they return to their initial position. The user can feel that additional force must be exerted to move the second catches 27*b* forward. It may even be arranged that the return of the second catches 27*b* to their original shape while rubbing against the hooks 30 produces a sound, such as a click. The user can then feel or hear a signal indicating that the cup 15 has reached the end of its travel. The case 1 thus reaches a third position (FIG. 3).

Figure 4:
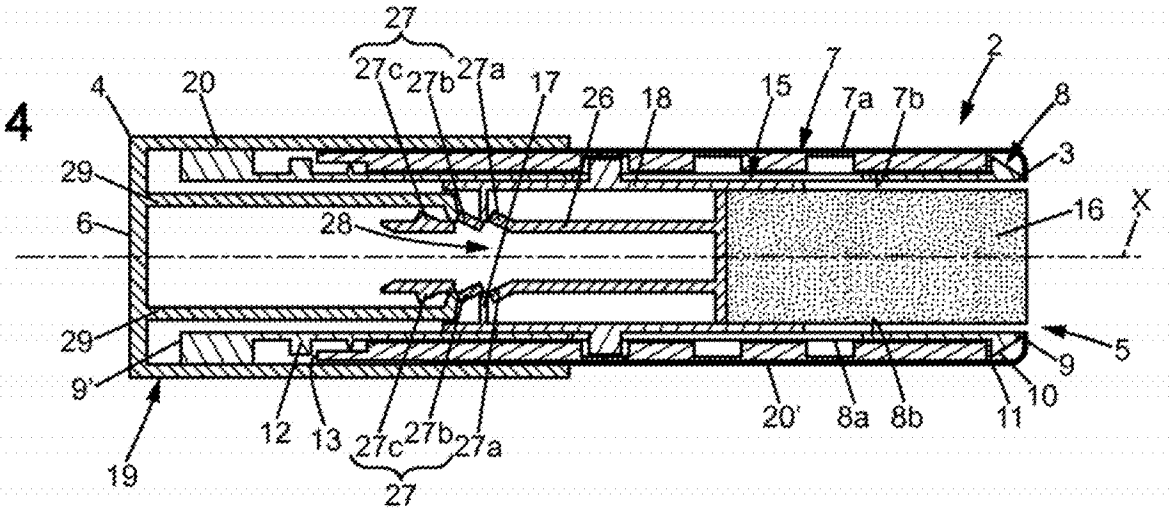
FIG. 4 represents the case of FIG. 1 in a fourth position where the cup has been moved in a second direction, the push member not having been moved, revealing a new portion of the stick.

So informed, the user then actuates the sleeve 20 in the other direction, to move the cup 15 longitudinally rearward within the sheath 2. The second catches 27*b* of the push member 24 abut against the hooks 30, blocking the push member 24 longitudinally against the sheath 2 so that the push member 24 does not follow the rearward translational movement of the cup 15 within the sheath 2. The head 25 of the push member 24 is thus moved away from the transverse base 17 of the cup 15, and the portion of the stick 16 still in the cup 15 emerges beyond the side wall 18 of the cup 15. The cup 15 is moved rearward in the sheath 2 until the edges of its hole 28 slide over the first inclined catches 27*a*, forming a ramp for the cup 15. The first catches 27*a* deform elastically to allow the cup 15 to move rearward relative to the sheath 2, until the transverse base 17 has moved beyond them. The first catches 27*a* are then positioned forward of the transverse base 17 of the cup 15, in the space newly formed between the head 25 of the push member 24 and the transverse base 17 of the cup 15. The user may again feel the extra force required to rotate the sleeve 20 to move beyond the first catches 27*a*, or may even hear a click. The user is thus informed that the case is in a fourth position where the cup 15 has reached a position uncovering a portion of the stick 16 lodged in the cup 15 (FIG. 4).

Figure 5:
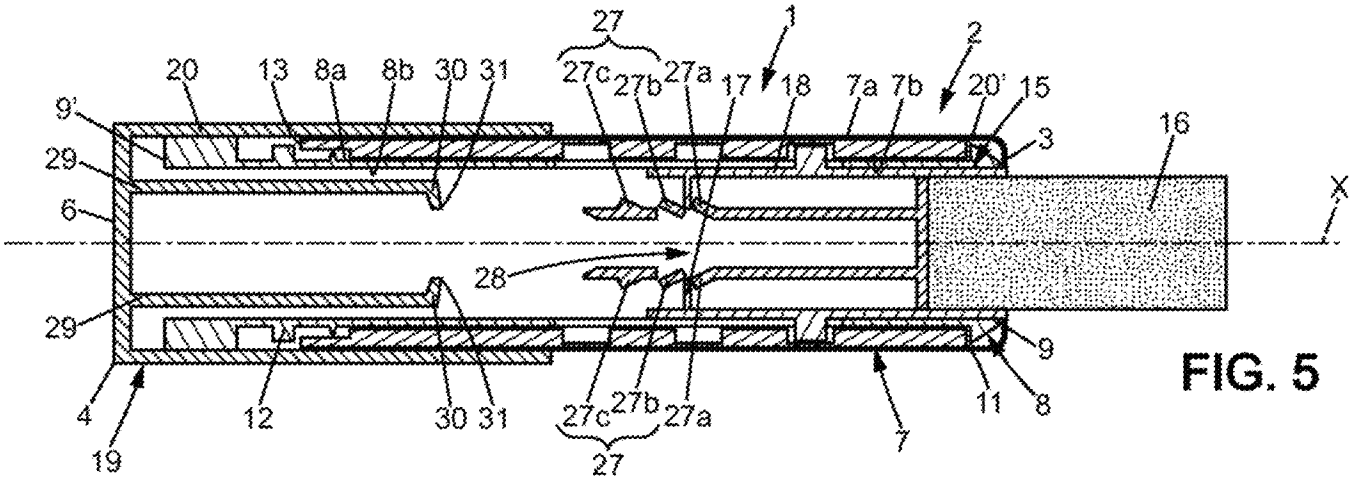
FIG. 5 represents the case of FIG. 1 in a fifth position where the cup has again been moved in the first direction, driving the push member, so that the new portion of the stick is exposed outside the sheath.
Figure 6:
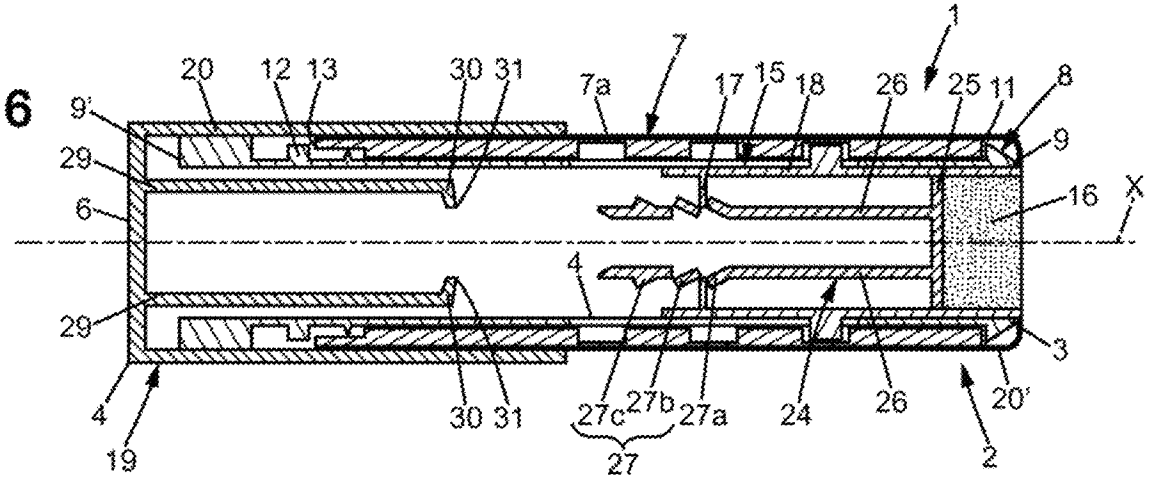
FIG. 6 represents the case of FIG. 1 in the same position as in FIG. 5, where the new portion of the stick has been used up.

The base 17 of the cup 15 is then blocked longitudinally by the first catches 27*a*. The push member 24, thus longitudinally blocking the cup 15 via the first catches 27*a*, cannot move rearward relative to the cup 15, meaning that any forward longitudinal translational movement of the cup 15 relative to the sheath 2 causes a forward thrust of the base 17 of the cup 15 against the first catches 27*a* of the push member 24. In other words, the push member 24 is integral with the cup 15 in any forward longitudinal translational movement of the cup 15 relative to the sheath 2, due to the first catches 27*a* in longitudinal abutment with the cup 15. Thus, when the user again actuates the sleeve 20 to move the cup 15 forward in the sheath 2, the push member 24 is moved longitudinally forward relative to the sheath 2 along with the cup 15, the head 25 of the push member 24 having moved the stick 16 relative to the cup 15 so that the previously inaccessible portion now outside of the cup 15 is available to the user outside the sheath 2, via the upper opening 5 (FIG. 5). The user can then use the portion of the stick 16 that is now accessible, until only the inaccessible material inside the cup 15 is once again all that remains (FIG. 6). The last catch 27*c* has moved beyond the hooks 30, such that the entire push member has advanced to the forward side of the hooks 30. The case 1 is then in a fifth position.

Figure 7:
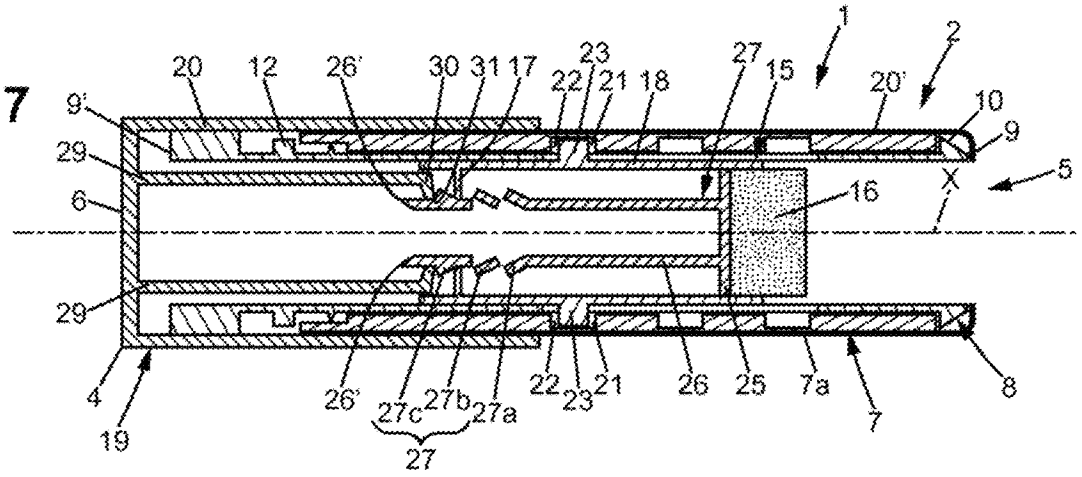
FIG. 7 represents the case of FIG. 1 in a sixth position where the cup has been moved in the second direction relative to FIG. 5, partially driving the push member in order to uncover the rest of the stick.
Figure 8:
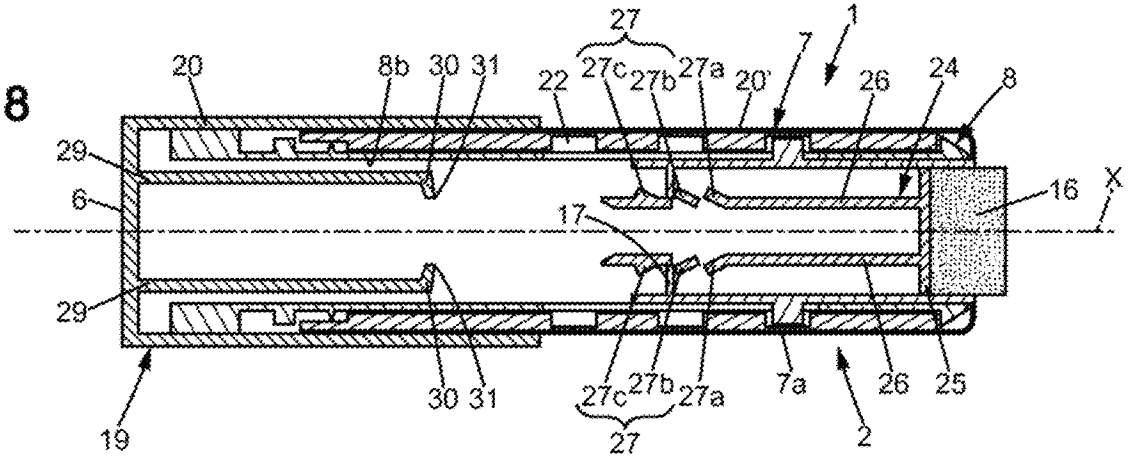
FIG. 8 represents the case of FIG. 1 in a seventh position where the cup has been moved in the first direction relative to FIG. 7, driving the push member so that the rest of the stick is exposed outside the sheath.

From the fifth position, the user actuates the sleeve 20 so that the cup 15 is moved rearward relative to the sheath 2, the friction of the stick 16 on the push member 24 and on the cup 15 being sufficient for the push member 24 to be driven rearward with the cup 15 relative to the sheath. The last catches 27*c* then abut longitudinally against the hooks 30, forming a stop for the push member 24 on the sheath 2, preventing the push member 24 from moving further rearward relative to the sheath 2. However, the cup 15 can continue moving rearward relative to the sheath 2, the edges of its hole 28 sliding over the second catches 27*b* which here form a ramp. Once the second catches 27*b* have been advanced forward of the head 25 of the push member, the user is informed of this either by the extra force needed to move beyond the second catches 27*b* or by hearing a click. The push member 24 is thus moved further forward relative to the cup 15, so that the head 25 of the push member 24 is further distanced from the base 17 of the cup 15 and allows the remainder of the stick 16 to exit the cup (FIG. 7). Actuating the sleeve 19 once again, to move the cup 15 longitudinally forward within the sheath 2, causes a forward longitudinal translational movement of the push member 24 relative to the sheath 2 by pushing against the second catches 27*b*. The rest of the stick 16 then protrudes the sheath and can be used (FIG. 8).

Alternatively, the push member 24 may comprise a plurality of combination catches 27*b*, distributed longitudinally along each arm 26 between the first catch 27*a* and the last catch 27*c*. The combination catch 27*b* has two successive functions, as it first abuts against the hooks 30 to prevent rearward longitudinal translational movement of the push member 24 relative to the sheath 2, and then it abuts against the base 17 of the cup 15 to prevent rearward longitudinal translational movement of the push member 24 relative to the cup 15. By thus making use of a plurality of combination catches 27*b*, the operations to expose the stick 16 as it is used up can be repeated gradually, preventing exposure of too long of a stick 16 outside the housing of the cup 15, which could cause the stick 16 to break.

The described case 1 advantageously allows exposing substantially all of the stick 16. The push member 24 allows gradually exposing the portion of the stick 16 that is lodged in the cup, by pushing it out of the cup 15 in multiple actuations. Thus, the stick 16 remains retained in the cup 15 in a satisfactory manner throughout its use, the length of the side wall 18 of the cup 15 in contact with the stick 16 decreasing with the length of the stick 16. The length of the side wall 18 of the cup 15 can thus be chosen to be greater than in the prior art, ensuring optimal retention of the stick 16 in the cup 15 before the push member 24 comes into play.

The invention claimed is:

1. Case specifically designed to contain a stick of solid or semi-solid product of material to be applied by friction, in particular a stick of lipstick, wherein the case comprises:

a cup, forming a housing for the stick, a tubular sheath extending according along the longitudinal axis, in which the cup is housed, comprising at a distal end a transverse bottom and at a proximal end a transverse opening, the sheath comprising elements for guiding the cup in translational movement within the sheath along the longitudinal axis, in a so-called "forward" direction along the longitudinal axis from the distal end toward the proximal end of the sheath and in a so-called "rearward" direction along the longitudinal axis from the proximal end toward the distal end of the sheath, a push member mounted to enable translational movement along the longitudinal axis relative to the cup, and comprising a head adapted to be placed in the housing of the cup and at least one arm extending along the longitudinal axis, the arm bearing at least one sheath-arresting catch, elements for actuating the translational movement of the cup along the longitudinal axis relative to the sheath, alternately in the forward direction and in the rearward direction, wherein the sheath comprises stop elements, the at least one sheath-arresting catch extending transversely so as to engage with the stop elements, allowing forward translational movement of the push member relative to the sheath along the longitudinal axis and serving to block rearward translational movement of the push member relative to the sheath along the longitudinal axis, rearward translational movement of the cup along the longitudinal axis when the push member is in abutment against the stop elements causing forward translational movement of the push member relative to the cup along the longitudinal axis.

2. Case according to claim 1, wherein the push member comprises a plurality of sheath-arresting catches distributed along the longitudinal axis which allow forward translational movement of the push member relative to the sheath along the longitudinal axis and which successively engage with the hooking elements by forward translational movement of the cup relative to the sheath along the longitudinal axis to block rearward translational movement of the push member relative to the sheath along the longitudinal axis.

3. Case according to claim 1, wherein the cup comprises a transverse base in which an opening is provided, the head of the push member extending forward from the base of the cup and the arm traversing the opening in the cup, and wherein the arm further comprises a cup-arresting catch, extending transversely and engaging with the edge of the hole of the cup to permit forward translational movement of the push member relative to the cup along the longitudinal axis and to block rearward translational movement of the push member relative to the cup along the longitudinal axis.

4. Case according to claim 3, wherein the arm comprises, starting from the head of the push member, a first catch serving as a cup-arresting catch and a last catch serving as a sheath-arresting catch, the arm further comprising at least one second catch arranged on the arm between the first catch and the last catch, the second catch or catches being dimensioned to serve as a sheath-arresting catch and as a cup-arresting catch.

5. Case according to claim 1, wherein the catch or catches are elastically deformable.

6. Case according to claim 1, wherein the stop elements comprise at least one arresting finger projecting from the bottom of the sheath and extended by a hook intended to engage with the at least one sheath-arresting catch.

7. Case according to claim 6, wherein the push member comprises two arms extending along the longitudinal axis, each catch of an arm being transversely aligned with a catch of the other arm, and wherein the sheath comprises two arresting fingers, each arresting finger being adapted to engage with the catch or catches of a corresponding arm.

8. Case according to claim 1, wherein the sheath comprises a tubular outer shell and a tubular inner shell that is mounted so as to rotate about the longitudinal axis within the outer shell and is blocked from translational movement within the outer shell along the longitudinal axis, the sheath further comprising a mechanism for actuating translational movement of the cup within the sheath along the longitudinal axis comprising elements for actuating rotation of the inner shell relative to the outer shell.

9. Case according to claim 8, wherein the inner shell is in a helical connection with the cup and the outer shell is in a sliding connection with the cup.

10. Case according to claim 8, wherein the outer shell is in a helical connection with the cup and the inner shell is in a sliding connection with the cup.

11. Case according to claim 1, further comprising a removable cap for sealing the transverse opening of the sheath.

12. Packaged product, in particular a cosmetic product, comprising a stick of material to be applied by friction, the stick being contained in a case according to claim 1.

* * * * *